US005906061A

United States Patent [19]

Adler

[11] Patent Number: 5,906,061

[45] Date of Patent: May 25, 1999

[54] DEVICE FOR FOLDING AND DISCHARGING LINEN FOR A DRY PRESSING MACHINE AND DRY PRESSING MACHINE INCORPORATING SUCH A DEVICE

[75] Inventor: Michel Adler, Villery, France

[73] Assignee: Electrolux Systemes de Blachisserie, Rosieres, France

[21] Appl. No.: 09/014,722

[22] Filed: Jan. 28, 1998

[30] Foreign Application Priority Data

Feb. 13, 1997 [FR] France ..... 9701673

[51] Int. Cl.[6] ..... D06F 65/02; D06F 67/06

[52] U.S. Cl. ..... 38/2; 38/143; 493/444

[58] Field of Search ..... 38/2, 8, 143, 11, 38/44, 52; 493/406, 413, 416, 444; 223/37

[56] References Cited

U.S. PATENT DOCUMENTS 2,914,320 11/1959 Petre .
4,569,672 2/1986 Marion et al. ..... 493/444 X
5,079,867 1/1992 Kober et al. .

FOREIGN PATENT DOCUMENTS 2479789 10/1981 France .
3220197 12/1983 Germany ..... 38/2
837215 11/1956 United Kingdom .
988477 7/1962 United Kingdom .
2073272 10/1981 United Kingdom .

*Primary Examiner*—Ismael Izaguirre
*Attorney, Agent, or Firm*—Pearne, Gordon, McCoy & Granger LLP

[57] ABSTRACT

On leaving a dry pressing or ironing machine, each piece of linen or washing is folded on a folding arm performing a reciprocating movement. The folding arm then bears on an entrance end of a conveyor (28), which is then driven (F2), so as to move the folded piece of linen towards a recovery tank. A freewheel mechanism (52) is simultaneously brought into a disengaged state, which has the effect of lowering a pressing roller (40) and rotating the latter by means of a belt (62). Driving the conveyor (28) in the reverse direction (F3) then brings the pressing roller (40) into the raised position, by means of the freewheel (52), a crank (54) and a rod (56).

6 Claims, 3 Drawing Sheets

DEVICE FOR FOLDING AND DISCHARGING LINEN FOR A DRY PRESSING MACHINE AND DRY PRESSING MACHINE INCORPORATING SUCH A DEVICE

DESCRIPTION

1. Technical Field

The invention mainly relates to a device designed for folding and discharging linen or washing on leaving a dry pressing or ironing machine. The invention also relates to a dry pressing or ironing machine incorporating such a device.

The device according to the invention is intended to be incorporatable into an industrial or semi-industrial dry pressing machine, or for association with such a machine. It is more particularly intended for dry pressing machines equipping establishments in which a large quantity of linen has to be handled every day, such as hospitals, clinics, retirement homes, restaurants, etc.

2. Prior Art

FR-A-2 479 789 proposes equipping a dry pressing machine with a device for folding and discharging the linen for the purpose of restoring the pressed, folded linen.

More specifically, said document relates to a dry pressing machine equipped with a rotary, pressing cylinder, which is heated from the inside and in which the linen is pressed between said cylinder and one or more endless pressing belts supported by satellite rollers. The pressed piece of linen then descends by gravity alternately to one side or the other of a folding arm performing a reciprocating movement at a given speed, below the vertical trajectory followed by the pressed linen. The piece of linen passing out of the machine is then deposited on the upper edge of the arm, forming folds on either side thereof over a given height.

When the complete piece of linen has passed out of the dry pressing machine, it is discharged by a conveyor to a reception tank for the folded linen. For this purpose, the upper end of the folding arm bears on the entrance end of the conveyor, against which it is held by a pressing roller. The advance of the conveyor in the folded linen discharge direction makes it possible to move the linen to the reception tank.

In a machine equipped with a folding and discharge device for the linen designed in this way, the pressing roller must be applied to the folded linen resting on the upper end of the folding arm as soon as the latter bears against the entrance end of the conveyor and the latter starts to be driven in the linen discharge direction. Thus, said action of the pressing roller is determinative for guaranteeing the progress of the linen up to the reception tank.

In order to arrive at this result, it is necessary for the pressing roller to be spaced apart from the conveyor prior to the bearing of the folding arm against the entrance end of the conveyor. Moreover, the upper part of the folding arm is in the form of a deformable strip, which can curve inwards against the conveyor when the pressing roller applies its upper end, supporting the piece of folded linen, to said conveyor.

In order to control the displacements of the pressing roller between its position spaced from the conveyor and its position applied against the latter, the conveyor drive roller and the pressing roller are conventionally equipped with complimentary cams. The cooperation of two cams for raising the pressing roller prior to the introduction onto the conveyor of the pressed, folded piece of linen suffers from the disadvantage of producing a noisy impact or shock whenever the pressing roller redescends by gravity at the start of the conveyor advance. Apart from the unpleasantness caused by the repeated noises, the impacts lead to premature wear to the gears.

It is also no longer possible to use such a cam system when the speed of movement of the linen in the dry pressing machine exceeds a certain threshold. This makes the existing linen folding and discharge devices unsuitable for modern, high output machines.

DESCRIPTION OF THE INVENTION

The invention mainly relates to a device for folding and discharging linen, whose original design makes it possible to ensure the raising of the pressing roller prior to the discharge by the conveyor of the dried, pressed linen, without giving rise to impacts or noise and whose operation is suitable for the high linen movement speeds proposed on modern machines.

According to the invention, this result is obtained by means of a device for folding and discharging linen, which is to be installed downstream of a linen exit area on a dry pressing machine, said device being characterized in that it comprises:

- a conveyor, whose entrance end is to be placed substantially facing said exit area, said conveyor being able to move in one or other direction under the action of drive means,
- a folding arm, whose upper end can perform a reciprocating movement between two extreme positions located beneath the exit area and on either side of the latter under the action of control means, one of these extreme positions corresponding to a bearing of the folding arm against the entrance end of the conveyor,
- a pressing roller displaceable between a lower position, where it rests by gravity on the entrance end of the conveyor, and an upper position, under the action of a mechanism permanently linking the pressing roller with the drive means, via unidirectional engagement means, which are disengaged in order to maintain the pressing roller in the lower position, when the conveyor passes in a linen discharge direction, and engaged for bringing the pressing roller into the upper position when the conveyor moves in the reverse direction.

In a device designed in this way, the use of unidirectional engagement means, such as a freewheel or any other technically equivalent means, makes it possible to ensure the raising and lowering of the pressing roller via a mechanism which does not produce any impact or shock and whose operating speed is not limited.

In a preferred embodiment of the invention, the pressing roller is mounted so as to rotate freely on two support levers articulated on a fixed spindle. The mechanism then comprises at least one crank integral with a driven member of the unidirectional engagement means and a rod respectively articulated to the crank and to one of the support levers.

In order to further facilitate the driving by the conveyor of the folded, pressed piece of linen, the pressing roller is advantageously rotated by drive means, via a flexible transmission member. The rotation of the pressing roller is thus obtained without any noise and no matter what the thickness of the folded piece of linen resting on the folding arm.

Advantageously, said flexible transmission member is an extensible belt mounted on a first pulley having a fixed axis and a second pulley integral with the drive roller of the conveyor, and which externally engages on a third pulley integral with the pressing roller.

In the preferred embodiment of the invention, the unidirectional engagement means incorporate a driving member integral with the drive roller of the conveyor.

The invention also relates to a dry pressing machine incorporating a linen folding and discharge device, such as has been defined hereinbefore.

BRIEF DESCRIPTION OF THE DRAWINGS

A preferred embodiment of the invention is described in greater detail hereinafter in a non-limitative manner and with reference to the attached drawings, wherein show.

DETAILED DESCRIPTION OF A PREFERRED EMBODIMENT

Figure 1:
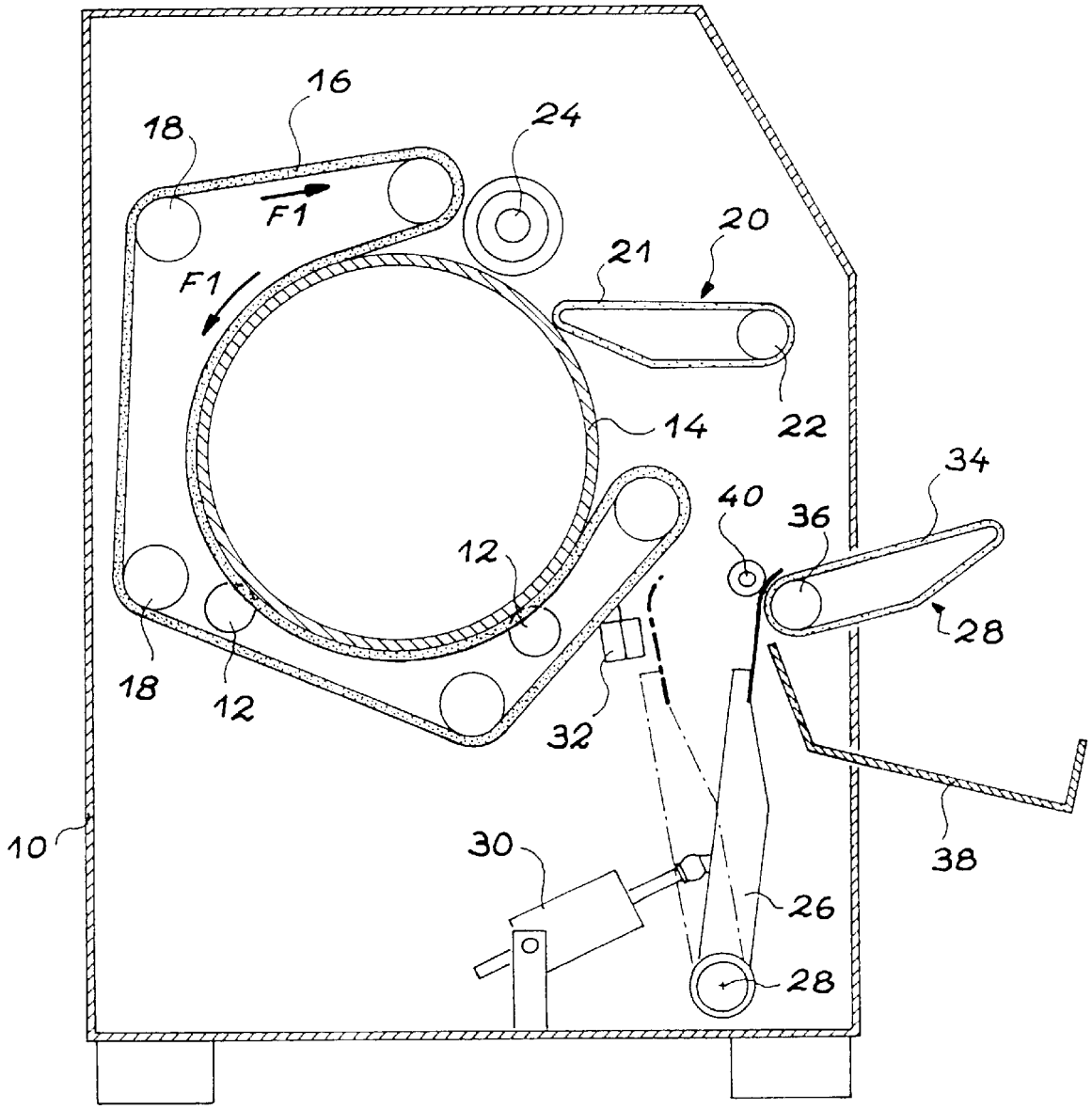
FIG. 1 A side view diagrammatically representing in partial section a dry pressing machine equipped with a linen folding and discharge device according to the invention.

FIG. 1 diagrammatically shows a dry pressing machine equipped with a linen folding and discharge device according to the invention. In order to facilitate understanding, only the most important parts have been shown.

The dry pressing machine illustrated in FIG. 1 comprises a chassis or frame 10 supporting by rollers 12 a pressing cylinder 14, whose geometrical axis is substantially horizontal.

The dry pressing machine also has one or more endless belts 16, which are installed on satellite rollers 18, whose geometrical axes are all parallel to the geometrical axis of the pressing cylinder 10. The endless belts 16 are in contact with the outer surface of the pressing cylinder 10 over the entire length thereof and over most of its circumference. As the rollers 12 support the pressing cylinder 10, the satellite rollers 18 supporting the endless belts 16 are carried by the machine chassis 10.

All the satellite rollers 18 are fitted so as to rotate freely on the chassis 10, with the exception of one of them, which is rotated by a not shown geared motor. When said geared motor is actuated, the endless belts 16 move in the direction of the arrows F1 in FIG. 1 and drive with them the pressing cylinder 14.

The not shown pieces of linen to be pressed are introduced between the endless belts 16 and the pressing cylinder 14 in the upper part of the latter. This introduction is ensured by an entrance conveyor 20 constituted by an endless belt 21 drivable by a motor roller 22. A linen introduction roller 24 is generally interposed between the entrance conveyor 20 and the entrance end of the endless belts 16, in order to ensure the application and driving of the pieces of linen to the outer surface of the pressing cylinder 14. This outer surface is generally coated with not shown molleton or table felt.

In order to ensure the pressing of the linen, the pressing cylinder 14 is internally heated by generally electric or gas-operated, not shown heating means.

According to the invention, a linen folding and discharge device is positioned downstream of a linen exit area positioned below the entrance conveyor 20. This device is shown integrated into the dry pressing machine. As a variant, it can constitute a device separate from the machine and which can be installed on an existing dry pressing machine not equipped with such a device.

The linen folding and discharge device according to the invention firstly comprises a folding arm 26, whose upper end performs a reciprocating movement between two extreme positions beneath the linen exit area, materialized by the lower ends of the endless belts 16 and on either side of said area.

More specifically, the folding arm 26 is articulated by its lower end about a fixed axis or spindle 28 parallel to the horizontal axis of the pressing cylinder 14. Control means, e.g. constituted by a double-action jack 30 are interposed between the folding arm 26 and the machine chassis 10, in order to ensure the aforementioned reciprocating movement of the folding arm.

In its upper part, the folding arm 26 is in the form of a flexible, deformable strip, which can alternately bear either against a fixed abutment 32 formed on the machine chassis 10, or against an entrance end of an exit conveyor 28, positioned substantially facing the linen exit area. The latter extreme position is shown in continuous line form in FIG. 1, whereas its first extreme position is shown in mixed line form.

If, by convention, the term "front face" of the machine is used for the face turned to the right in FIG. 1 and on which are installed the entrance 20 and exit conveyors 28, it can be seen that the upper edge of the folding arm 26 is displaced respectively rearwards or forwards with respect to the linen exit area, depending on whether it bears against the abutment 32 or against the entrance end of the exit conveyor 28. Consequently, by controlling the pivoting of the folding arm 26 at regular time intervals, when a piece of linen passes out of the dry pressing machine, said piece is progressively deposited in the form of a certain number of folds on the upper edge of the folding arm 26. When the piece of linen has completely left the machine, it consequently entirely rests on the arm 26 hanging by gravity on either side thereof. For further details concerning this operation, reference should be made to FR-A-2 479 789, incorporated here by reference.

As is also illustrated in FIG. 1, the exit conveyor 28 is installed on the dry pressing machine chassis 10, substantially facing the exit area and in front of the latter. The entrance end of the conveyor 28 is still at a level slightly lower than the exit area for the linen, so that the arm can pass beneath the latter and bear against the conveyor.

The exit conveyor 28 is constructed in substantially the same way as the entrance conveyor 20. In particular, it comprises an endless belt 34, whose rear end, materializing the entrance end of the conveyor 28, rests on a drive roller 36.

Figure 2:
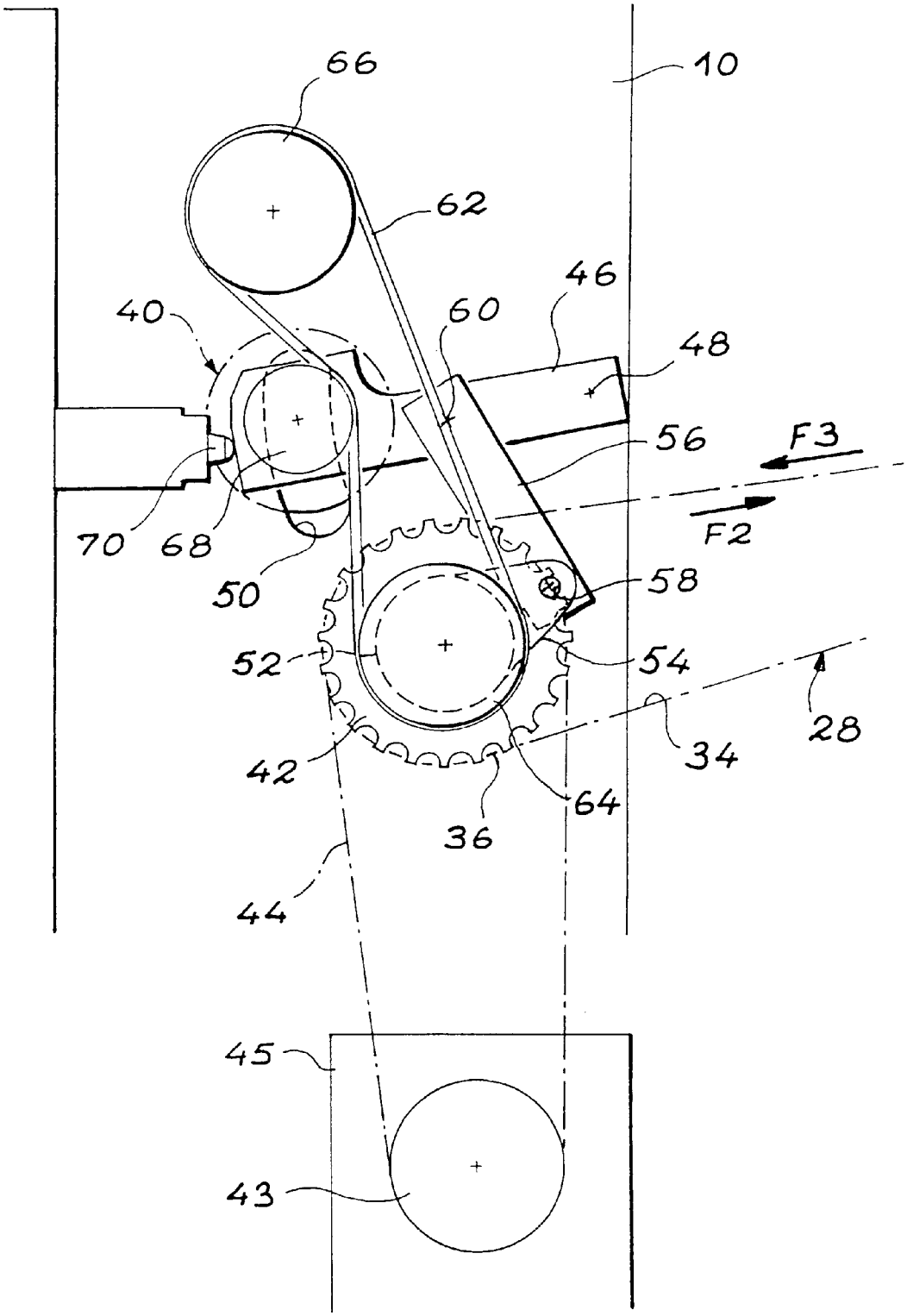
FIG. 2 A diagrammatic sectional view on a larger scale of the linen discharge device equipping the machine of FIG. 1, when the pressing roller is in its upper position moved apart from the conveyor.
Figure 3:
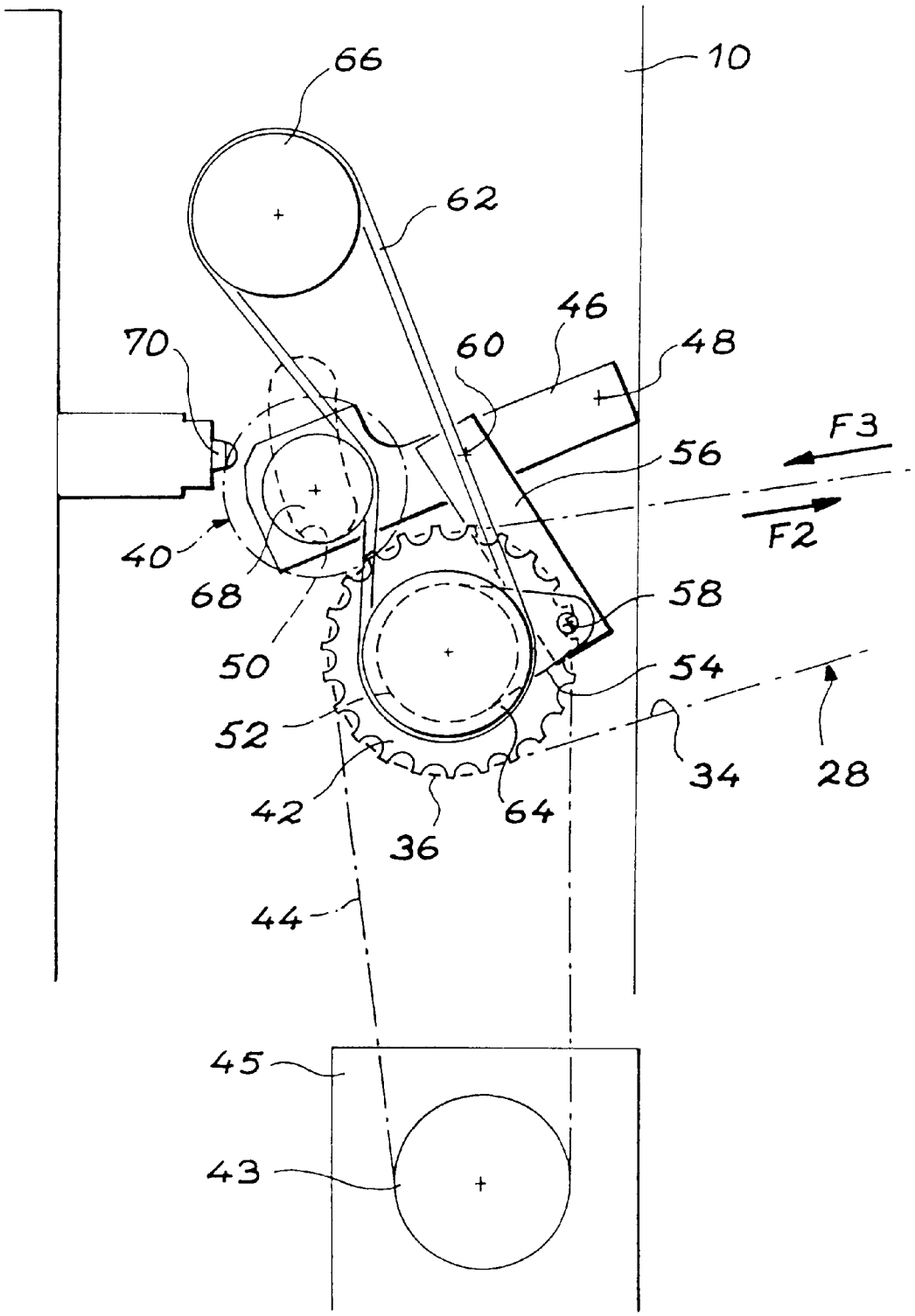
FIG. 3 A comparable view to FIG. 2 showing the linen discharge device when the pressing roller bears against the conveyor.

The device also comprises a pressing roller 40, which is mounted on the machine chassis 10, so as to be displaceable between an upper position and a lower position, respectively illustrated in FIGS. 2 and 3.

More specifically, when it occupies its lower position illustrated in FIG. 3, the pressing roller 40 rests by gravity on the entrance end of the conveyor 28. Conversely, when it occupies its upper position illustrated in FIG. 2, the pressing roller 40 is spaced from the conveyor 28, so as to permit the passage of the upper end of the folding arm 26 during its reciprocating movements.

Besides the folding arm 26, the exit conveyor 28 and the pressing roller 40, the linen folding and discharge device according to the invention can comprise a folded linen recovery tank 38, placed below the exit end of the conveyor 28.

The arrangement recommended by the invention for controlling the displacements of the pressing roller 40 between its upper and lower positions will now be described in detail relative to FIGS. 2 and 3.

As illustrated in FIGS. 2 and 3, the drive roller 36 of the exit conveyor 28 carries, at one of its ends, a sprocket 42 on which engages a chain 44. At its lower end, the chain 44 engages on another sprocket 23, which can be rotated in one or other direction by a geared motor 45. The geared motor 45, together with the chain 44 and sprockets 42 and 43, forms the drive means for the conveyor 28.

At each of its ends the pressing roller 40 is supported by a support lever 46, so as to be able to rotate freely about its axis with respect to the support levers. More specifically, the pressing roller 40 is mounted in rotary manner at the rear ends of the support levers 46, whereas the front ends of the latter are articulated to the machine chassis 10 about a fixed axis 48. Circular arc openings 50, centred on the fixed axis 48, are made in the chassis 10, so as to permit the passage of the spindle of the pressing roller 40 during its displacement between its upper and lower positions.

According to the invention, the displacement of the pressing roller 40 between its upper and lower positions is ensured by a mechanism permanently connecting said pressing roller to the drive means of the exit conveyor 28 via unidirectional engagement means.

More specifically, in the embodiment illustrated in FIGS. 2 and 3, said unidirectional engagement means incorporate a freewheel 52, whose driving, central part is integral with the sprocket 42 and the drive roller 36 of the conveyor 28. The outer, driven part of the freewheel 52 is integral with a crank 54, to whose end is articulated a first end of a rod 56 by means of a spindle 58. The opposite end of the rod 56 is articulated by a spindle 60 to the support lever 46 supporting the adjacent end of the pressing roller 40. More specifically, the spindle 60 is approximately equidistant between the fixed axis 48 and the axis of the pressing roller 40.

It should be noted that an identical mechanism is installed between the drive roller 36 and the support lever 46, at the other end of the drive roller 36 and the pressing roller 40. More specifically, at its end opposite to the sprocket 42, the drive roller 36 is in this case connected to the corresponding support lever 46 via a second freewheel identical to the freewheel 52, a second crank identical to the crank 54 and a rod identical to the rod 56. The doubling of the mechanism makes it possible to ensure an effective transmission of movements, despite the considerable length of the machine.

The freewheels installed at each end of the drive roller 36 are arranged in such a way that they are in a disengaged state when the exit conveyor 28 moves in the direction of the arrow F2 corresponding to the discharge of the linen, i.e. towards the front of the machine on its upper face. Thus, when the exit conveyor 28 moves in the direction of the arrow F2, the crank 54 is not rotated and the pressing roller 40 simply rests by gravity on the entrance end of the conveyor 28. In this state, illustrated in FIG. 3, the piece of folded and pressed linen resting on the upper edge of the folding arm 26 is gripped between the pressing roller 40 and the conveyor 28 and automatically driven by the latter towards the recovery tank 38 (FIG. 1).

Conversely, when the drive means acting on the drive roller 36 are actuated in the reverse direction, i.e. corresponding to a rearward displacement of the upper face of the endless conveyor belt 34, as illustrated by arrow F3, the freewheels are in an engaged state. Thus, the crank 54 is driven in a counterclockwise direction on considering FIGS. 2 and 3. This has the effect of controlling the upward pivoting of the support levers 46 carrying the pressing roller 40 about their fixed axis 48, via rods 56. The pressing roller 40 is then brought into the upper position illustrated in FIG. 2.

As illustrated in FIGS. 2 and 3, a flexible drive member, preferably constituted by an extensible belt 62, advantageously connects the drive roller 36 to the pressing roller 40, so that the latter is automatically driven in the reverse direction of the drive roller 36. This arrangement facilitates the driving by the exit conveyor 28 and the pressing roller 40 of the pressed, folded piece of linen resting on the upper edge of the folding arm 26.

In the embodiment illustrated in FIGS. 2 and 3, the belt 62 is installed on a pulley 64 integral with the sprocket 42 and on a return pulley 66, whose spindle is fixed to the machine chassis 10 and it travels between said two pulleys. In order to ensure the reverse driving of the pressing roller 40, the rear strand of the belt 62 engages, by its outer face, on a third pulley 68 integral with the pressing roller 40.

In order to complete the description of the linen folding and discharge device illustrated in FIGS. 2 and 3, the latter show that the device also comprises a microcontact 70, installed on the machine chassis 10 in a position such that it automatically detects the arrival of the pressing roller 40 in the upper position.

The implementation of the drive means of the exit conveyor 28 is controlled by a robot, in response to signals supplied by the different sensors installed on the drive pressing machine, said sensors in particular including the microcontact 70.

This robot brings the pressing roller 40 into the upper position, as illustrated in FIG. 2, as soon as a pressed, folded piece of linen has dropped into the recovery tank 38. To this end, the drive means 42–45 of the exit conveyor 28 are then actuated in the direction corresponding to the displacement of the endless conveyor belt 34 in accordance with arrow F3, until the microsensor 70 detects the arrival of the pressing roller 40 in the upper position. The drive means 42–45 of the exit conveyor 28 are then stopped and remain inactive for as long as the folding of the following piece of linen has not been completed.

When the latter condition has been fulfilled, i.e. when a piece of linen has entirely passed out of the machine and rests on the upper edge of the folding arm 26, the latter is made to bear against the entrance end of the exit conveyor 28. The drive means of said conveyor 28 are then actuated in the direction corresponding to the discharge of the linen, i.e. in the direction of the arrow F2 in FIG. 2.

From the start of this actuation, the freewheels release the pressing roller 40, which drops by gravity so as to grip the flexible, deformable strip forming the upper part of the folding arm 26, as well as the pressed, folded piece of linen supported by said strip. Therefore the piece of linen is automatically driven by the conveyor 28 and advanced into the recovery tank 38.

The same operations are then repeated in an identical manner until all the pieces of linen have been pressed.

As a result of the use of unidirectional engagement means such as the freewheel 52 for controlling the displacements of the pressing roller 40 between its upper and lower positions, said displacements take place virtually without noise and with reduced wear.

Moreover, the arrangement proposed makes it possible to ensure a satisfactory operation, even when the linen travel speed in the drive pressing machine is significantly increased compared with that of existing machines.

It should finally be noted that the use of the belt 62 for rotating the pressing roller 40 in the reverse direction compared with the displacement of the exit conveyor 28 guarantees an effective drive of the pressing roller, no matter what the thickness of the pressed, folded piece of linen.

I claim:

1. Device for folding and discharging linen, which is to be installed downstream of a linen exit area on a dry pressing machine, said device being characterized in that it comprises:

a conveyor, whose entrance end is to be placed substantially facing said exit area, said conveyor being able to move in one or other direction under the action of drive means, a folding arm, whose upper end can perform a reciprocating movement between two extreme positions located beneath the exit area and on either side of the latter under the action of control means, one of these extreme positions corresponding to a bearing of the folding arm against the entrance end of the conveyor, a pressing roller displaceable between a lower position, where it rests by gravity on the entrance end of the conveyor, and an upper position, under the action of a mechanism permanently linking the pressing roller with the drive means, via unidirectional engagement means, which are disengaged in order to maintain the pressing roller in the lower position, when the conveyor passes in a linen discharge direction, and engaged for bringing the pressing roller into the upper position when the conveyor moves in the reverse direction.

2. Device according to claims 1, wherein the pressing roller rotates freely on two support levers articulated on a fixed spindle, said mechanism incorporating at least one crank integral with a driven member of the unidirectional engagement means and a rod respectively articulated on the crank and on one of the support levers.

3. Device according to claim 1, wherein the pressing roller is rotated by the drive means, via a flexible transmission member.

4. Device according to claim 3, wherein the flexible transmission member is an extensible belt mounted on a first pulley having a fixed axis and on a second pulley integral with a drive roller of the conveyor, said bolt externally engaging on a third pulley, integral with the pressing roller.

5. Device according to claim 1, wherein the unidirectional engagement means incorporate a driving member integral with a drive roller of the conveyor.

6. Drive pressing machine comprising:

a rotary pressing cylinder, at least one endless belt, in contact with the cylinder over part of its circumference, so as to define a linen entrance area and exit area, a conveyor, whose entrance end is to be placed substantially facing said exit area, said conveyor being able to move in one or other direction under the action of drive means, a folding arm, whose upper end can perform a reciprocating movement between two extreme positions located beneath the exit area and on either side of the latter under the action of control means, one of these extreme positions corresponding to a bearing of the folding arm against the entrance end of the conveyor, a pressing roller displaceable between a lower position, where it rests by gravity on the entrance end of the conveyor, and an upper position, under the action of a mechanism permanently linking the pressing roller with the drive means, via unidirectional engagement means, which are disengaged in order to maintain the pressing roller in the lower position, when the conveyor passes in a linen discharge direction, and engaged for bringing the pressing roller into the upper position when the conveyor moves in the reverse direction.

* * * * *